United States Patent [19]

Harvard

[11] 4,443,000

[45] Apr. 17, 1984

[54] FLEXIBLE COUPLINGS FOR MECHANICAL JACKING DEVICES USED IN THE INSTALLATION OF MARINE PLATFORMS

[75] Inventor: Jean F. Harvard, Carquefou, France

[73] Assignee: Brissonneau et Lotz Marine, France

[21] Appl. No.: 334,724

[22] Filed: Dec. 28, 1981

[30] Foreign Application Priority Data

Dec. 31, 1980 [FR] France ..... 80 27914

[51] Int. Cl.[3] ..... E02B 17/04

[52] U.S. Cl. ..... 254/89 R; 254/95

[58] Field of Search ..... 254/95, 105, 106, 108, 254/89 R, 89 H; 248/632, 634; 267/141.3

[56] References Cited

U.S. PATENT DOCUMENTS

| | | | |
|---|---|---|---|
| 2,538,954 | 1/1951 | Efromson et al. | 267/141.3 |
| 3,007,317 | 11/1961 | Suderow | 254/105 |
| 3,007,676 | 11/1961 | Javorik | 254/103 |
| 3,606,251 | 9/1971 | Willke et al. . | |
| 3,986,368 | 10/1976 | Levingston | 254/105 |
| 4,142,701 | 3/1979 | Fujii et al. | 248/632 |

FOREIGN PATENT DOCUMENTS

| | | | |
|---|---|---|---|
| 796231 | 6/1958 | United Kingdom | 267/141.3 |
| 1089669 | 11/1967 | United Kingdom . | |

*Primary Examiner*—Robert C. Watson

*Attorney, Agent, or Firm*—Rines and Rines, Shapiro and Shapiro

[57] ABSTRACT

The present invention applies to those auto-elevating marine platforms, as for deep-sea drilling and the like, outfitted with a number of legs and a number of associated jacking mechanisms of the rack and pinion type set with the rack's teeth in opposition, wherein a flexible coupling (5), the axis of compression of which is inclined, is placed between the support-framework (2), where the pinions (3) are mounted, and the main structure (1) of the platform in such a way that a relative freedom of movement between the support-framework (2) and the structure (1) is permitted. The intention is that the axis of compression of the flexible coupling (5) passes substantially directly through the instantaneous center of rotation of the upper part of the leg.

4 Claims, 2 Drawing Figures

Figure 1:
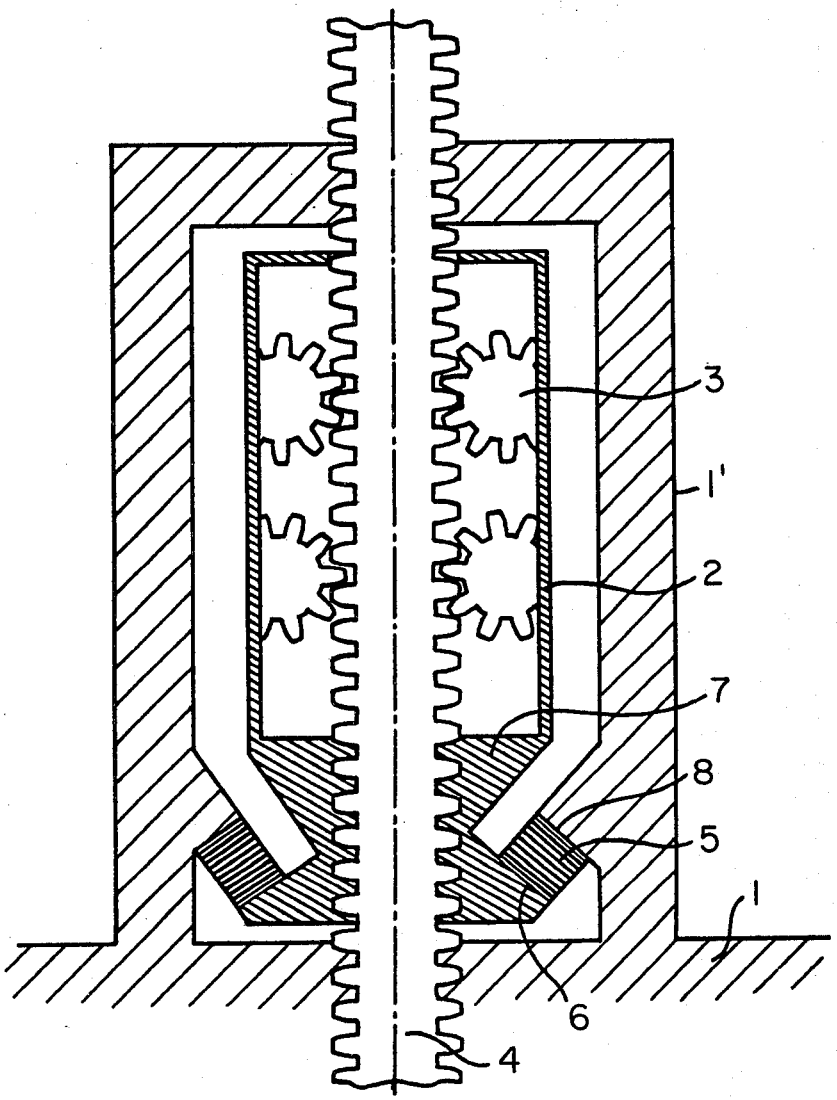

FLEXIBLE COUPLINGS FOR MECHANICAL JACKING DEVICES USED IN THE INSTALLATION OF MARINE PLATFORMS

The present invention relates to jacking devices employed in the installation of marine platforms and the like, such as those designed essentially for off-shore drilling operations and similar uses.

These platforms are outfitted with a number of "legs" and a number of rack and pinion gear-type jacking devices whose function is to control and maintain the position of the legs.

To achieve that end, at least two racks, with their teeth in opposition, are rigidly mounted on each leg. At least one pair of pinions is linked to the platform structure itself by means of a supporting framework. Each pinion mates with its respective rack and can be rotated either forward or reverse by means of a motor-coupled reduction gear drive. This arrangement permits the platform to be either raised or lowered.

It should be stated, regarding a similar type of prior jacking mechanism, that a method has already been conceived whereby the pinion-support framework is mated to the main platform by means of a flexible coupling that permits a mild lateral displacement of the legs in relation to the platform structure. This method was described in U.S. Pat. No. 3,606,251 and in British Pat. No. 1,089,669.

This type of flexible coupling can be fabricated through a technique where steel strips are interleaved with strips of some elastic material. This "sandwich" design offers great resistance to compression while permitting axial, and to some extent, transverse deformation. Consequentially a relative freedom of movement is possible between the pinion-support framework and the platform structure itself.

A major drawback of this design, however, is that, in operation, the flexible coupling is subject to compressive and shearing forces simultaneously.

The object of this invention, therefore, is to provide a new and improved flexible coupling arrangement, eliminating, in so far as possible, these potentially destructive forces by locating the flexible coupling between the pinion-support framework and the platform structure in a more advantageous position.

Other and further objects are later presented and are more fully delineated in the appended claims.

One of the prime benefits of this novel placement of flexible coupling resides in the fact that the pinion-support framework can track the angular displacement of the leg without the necessity of sustaining the variety of strain forces noted in prior flexible couplings. The result is that the forces sustained by the pinions remain markedly constant.

This invention is particularly applicable to those well-known marine platforms where the jacking mechanism is composed of two groups of pinions, rotated by means of motor-coupled reduction gears and mounted on a supporting framework which is fixed to the platform structure itself. The pinions of one or the other group engage, respectively, with a set of the rack's two rows of parallel and opposed teeth which, in effect, are responsible for the movement of the corresponding leg.

In summary, with the present invention, the axis of compression of the flexible coupling is tilted in such a manner that it permits mounting the coupling at an oblique angle. The angle of inclination is such that the axis of compression passes through the instantaneous center of rotation of the upper portion of the legs.

Figure 2:
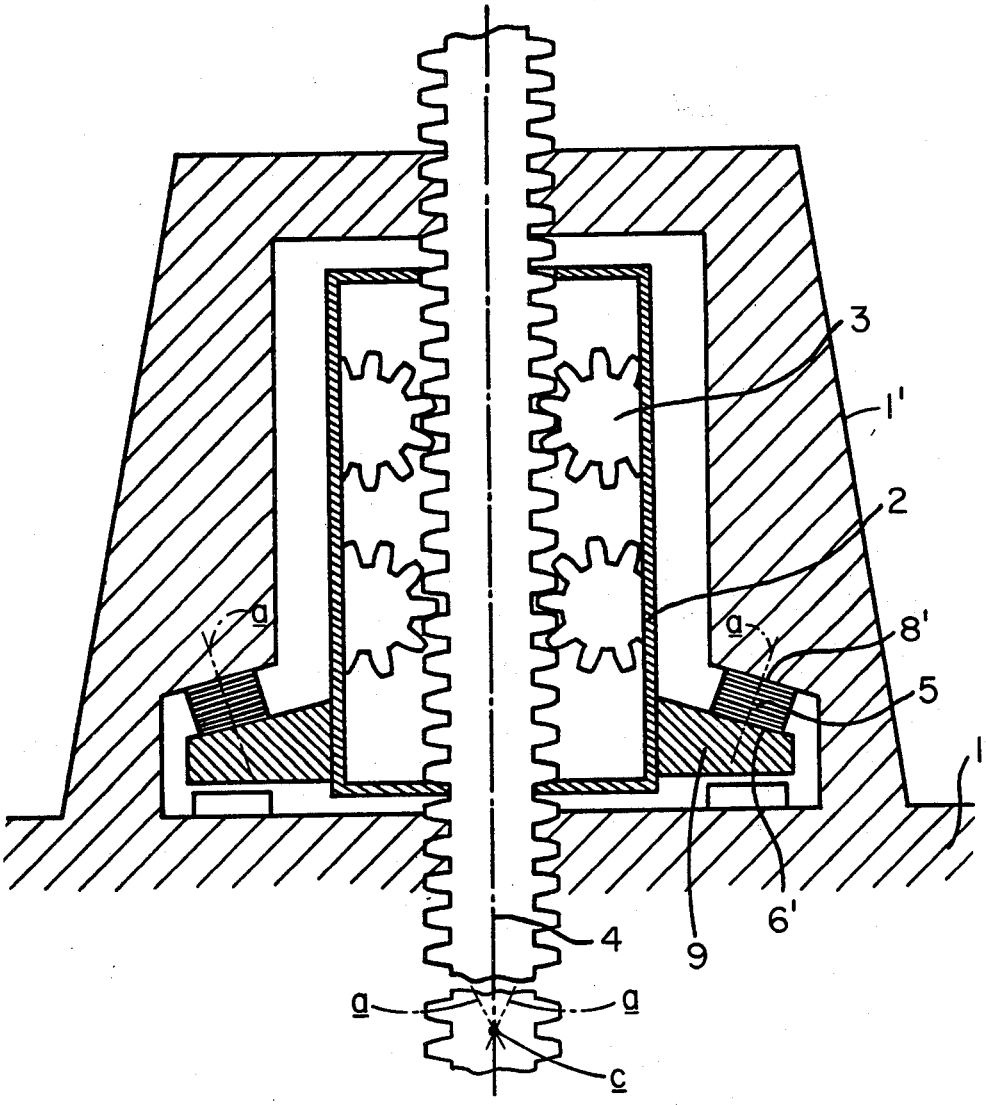

The invention will be more fully described and its characteristics and advantages understood by reference to the accompanying drawings, FIG. 1 of which illustrates a longitudinal cross-section of a preferred apparatus utilizing this invention; and FIG. 2 is a similar view of a modification.

Referring now to the drawings, the platform structure itself is referenced at (1) having an integral drive housing (1'). A supporting framework (2) is provided within the platform housing (1') for motors which turn driving pinions (3) (shown paired in the examples of FIGS. 1 and 2). Rotation of the pinions (3) controls the motion of the platform elevating and depressing twin (opposing teeth) racks 4 connected below to the plurality of platform-support legs (not shown). Rotation of the pinions in one direction determines the vertical height of the platform above the sea, while simultaneously setting the legs on the sea bed. Rotation of the pinions in the other direction, jacks the legs up from the sea bed, enabling flotation of the platform, providing an auto-elevating system.

According to the arrangement represented in FIG. 1, the flexible couplings (5), serving as shock absorbers, are interposed between an inclined (to the vertical and horizontal) or oblique-angle plate (6) set in a recess on the foot (7) depending from the bottom of the support-framework (2) within the housing (1'), and a corresponding substantially parallel juxtaposed surface of an adjacent lower side wall projection of the housing (1')—the same being responsible for raising the platform.

According to the arrangement shown in FIG. 2, however, the shock absorbers of the flexible couplings (5) are interposed between a lower outwardly and laterally extending flange (9) at the bottom of the framework (2) having an oblique-angle plate (6'), together with a surface (8') in a lower recess of the inner bottom wall of the platform housing (1')—again, which serves to raise the platform structure.

In the two examples depicted in FIGS. 1 and 2, the axes of compression a of the flexible couplings are inclined (see FIG. 2). The plates (6) and (8) or (6') and (8'), in the space between and contacting the supporting surfaces on which they are mounted, are inclined at the same angle relative to the horizontal and have the same effect.

The intention is to determine that the axes of compression a pass measurably through the instantaneous center of rotation c of the upper part of the leg(s). The effect of this placement is to suppress in so far as possible any fluctuation in the compressive strain-forces to which the flexible coupling (5) is subjected. Only a shearing force is in operation. The result of this design, therefore, is that the force applied to the teeth of the pinions (3) remains remarkably constant through their total range of movement.

It is evident that other modifications can be made that remain within the scope of this invention as defined in the claims, including in this regard, especially, the placement, angle of inclination and the number of flexible couplings employed for each jacking mechanism.

What is claimed is:

1. In a jacking mechanism of the rack and pinion gear type for the control and maintenance of the vertical positioning of a platform and the like on resting legs to which twin racks, with their teeth in opposition, are rigidly connected and form part of a jacking mechanism associated with at least one pair of pinions carried by means of a support-framework, and wherein each tooth of the pinions meshes respectively with one of the two sets of teeth of its corresponding rack in such a way as to be always in contact with one side or the other, with the pinions motor-rotatable to control the desired up or down movement of the racks, and wherein said legs have an upper part with an instantaneous center of rotation, the improvement of means at the bottom of the support-framework providing a first oblique-angle supporting surface; means connected with the main structure of the platform and providing a second supporting surface spaced from but substantially parallel to said oblique-angle surface; and flexible coupling means interposed in the space between and contacting said supporting surfaces for permitting relative freedom of movement between the support-framework and the platform structure, the coupling means having an axis of compression and being disposed so that the axis of compression is oriented to pass through the instantaneous center of rotation of the upper part of the said legs.

2. A jacking mechanism as claimed in claim 1 wherein the support-framework has a foot with a recess therein, said first supporting surface comprises an obliquely oriented plate disposed in said recess, and the second supporting surface comprises an obliquely positioned plate rigidly secured to the platform structure.

3. A jacking mechanism as claimed in claim 1 and in which the first and second supporting surfaces are, respectively, an obliquely positioned plate mounted on one part of the support-framework, and a corresponding obliquely positioned plate secured to the platform structure to enable raising the same.

4. A jacking mechanism for a vertical-direction auto-elevating marine platform and the like outfitted with a number of legs and a number of associated jacking mechanisms disposed within a support-framework and of the rack and pinion type set with the rack's teeth in opposition, said legs having an upper part with an instantaneous center of rotation, said mechanism having, in combination, oblique-angle supporting surface means carried by the said support-framework; juxtaposed but spaced similar oblique-angle supporting surface means carried by the platform; flexible coupling means having an inclined axis of compression, said flexible coupling means contacting and interposed in the space between said supporting surface means so as to permit relative freedom of movement between the support-framework and the platform structure, with the axis of compression of the flexible coupling means passing substantially through the instantaneous center of rotation of the upper part of the legs.

* * * * *